US006174183B1

(12) United States Patent
Ono et al.

(10) Patent No.: US 6,174,183 B1
(45) Date of Patent: Jan. 16, 2001

(54) COAXIAL CABLE CONNECTOR WITH NORMALLY CLOSED SWITCH

(75) Inventors: Hisahiro Ono; Kazuhiko Nakamura, both of Tsu (JP)

(73) Assignee: Matsushita Electric Works, Ltd., Osaka (JP)

( * ) Notice: Under 35 U.S.C. 154(b), the term of this patent shall be extended for 0 days.

(21) Appl. No.: 09/209,274

(22) Filed: Dec. 11, 1998

(30) Foreign Application Priority Data

Dec. 19, 1997 (JP) ..... 9-351175

(51) Int. Cl.[7] ..... H01R 29/00
(52) U.S. Cl. ..... 439/188; 200/51.1; 439/944
(58) Field of Search ..... 439/188, 944; 200/51.1

(56) References Cited

U.S. PATENT DOCUMENTS 5,368,494 * 11/1994 Lai ..... 439/188

* cited by examiner

*Primary Examiner*—Neil Abrams
(74) *Attorney, Agent, or Firm*—Greenblum & Bernstein, P.L.C.

(57) ABSTRACT

A connector for a coaxial cable that includes a body molded of an insulating material having a tubular portion projecting outwardly from a surface of the body. The body and tubular portion having a common internal cavity with an aperture at a distal tip of the tubular portion, a hollow passageway within the tubular portion connected to the aperture, and a housing space located within the body and contiguously connecting to the hollow passageway. A common terminal made of conductive material is fitted within the internal cavity of the body, and has a first contact piece at one end and a soldering terminal at an other end. A receiving terminal made of conductive material is also fitted within the internal cavity and has a second contact piece at one end and a soldering terminal at an other end. The first and second contact pieces are configured to form an electrical switch, and the connector is adapted to connect a male connector of a coaxial cable to an outer side of the tubular sleeve portion so that a male center contact of the male connector is inserted into the aperture of the tubular portion so as to form an electrically conductive contact with the common terminal and causes the switch to assume an open orientation.

6 Claims, 6 Drawing Sheets

COAXIAL CABLE CONNECTOR WITH NORMALLY CLOSED SWITCH

BACKGROUND OF THE INVENTION

1. Field of the Invention

The present invention relates to a connector for a coaxial cable and particularly to the connector which electrically connects a plug with a receptacle and has a switch operable in response to insertion or removal of the plug into or from the receptacle.

2. Description of the Related Art

The coaxial cable connector has long been well known comprising a plug and a receptacle, an example of which is shown in FIGS. 7A and 7B in a schematic longitudinal section representation. Particularly, FIG. 7A shows the conventional coaxial cable connector without the plug having not yet been inserted, and FIG. 7B shows the same coaxial connector with the plug having been inserted.

Referring to these figures, the connector 1 for a coaxial cable has a body 10, which is molded of, for example, synthetic resin. The body 10 has a recess 11 defined therein so as to extend inwardly from one end thereof, and also has a tubular body 12 protruding a distance from the bottom of the recess so as to face the opening of the recess 11. The tubular body 12 has a housing space 13 defined therein. A normally closed switch 5 is accommodated in the tubular body 12. The switch 5 includes a displaceable terminal 3 and a stationary terminal 4, both of which are made of an electroconductive material. The tubular body 12 is provided with a ground terminal 6 encircling an outer surface thereof. A receptacle 2 consists of the tubular body 12, the switch 5 and the ground terminal 6. The receptacle 12 is adapted to removably receive therein a plug 7 coupled with the coaxial cable. The tubular body 12 has an aperture 14 defined on one end thereof within the recess 11 and communicating the housing space 13 with the recess 11 therethrough. An inner peripheral edge of the tubular body 12 around the aperture 14 is inwardly tapered at 15 to facilitate insertion of a center contact 7*a* of the plug 7 into the aperture 14.

The stationary terminal 4 is disposed within the housing space 13 and fixedly held against an inner wall of the tubular body 12 defining the housing space 13 so as to face the displaceable terminal 3. The displaceable terminal 3 has a base portion 37 fixedly held against the inner wall of the tubular body 12 defining the housing space 13 at a location opposite to the position of the stationary terminal 4 with an end portion 38 of the displaceable terminal 3 disposed within the housing space 13 so as to face the aperture 14. The displaceable terminal 3 is urged toward the stationary terminal 4 by its own resiliency. Therefore, as shown in FIG. 7A, a contact portion 39 of the displaceable terminal 3 that is situated between the end portion 38 and the base portion 37 is held in contact with stationary terminal 4 thereby to keep the switch 5 closed when the plug 7 is not connected to the receptacle 2. On the other hand, as shown in FIG. 7B, when the plug 7 is connected to the receptacle 2 with the center contact 7*a* inserted into the housing space 13 through the aperture 14, the center contact 7*a* is brought into sliding contact with the end portion 38 causing the end portion 38 to separate away from the stationary terminal 4. In this condition of FIG. 7B, not only is the center contact 7*a* of the plug 7 connected electrically with the displaceable terminal 3, but the normally closed switch 5 is opened.

Also, the center contact 7*a* urges the end portion 38 that is further from base portion 37 than the contact portion 39, so long as the plug 7 is connected to the receptacle 2.

Therefore, the distance of travel of the end portion 38 is small. As a result, a contact gap G between the displaceable terminal 3 and the stationary terminal 4 is so small that an insulation characteristic would likely become worse. Also, the connector 1 for the coaxial cable could not be made compact. Further, if the accuracy with which parts such as the displaceable terminal 3 or the stationary terminal 4 are machined insufficiently, the switch 5 will fail to operate properly.

Also, where the connector is downsized, the size of the taper 15 becomes too small and is likely to fail to guide the center contact 7*a* inserted through the aperture 14. Also, as the end portion 38 is repeatedly depressed by the center contact 7*a*, then the displaceable terminal 3 is likely to be set in a buckled state. Therefore, it is difficult to downsize the connector.

SUMMARY OF THE INVENTION

The object of the present invention is therefore to provide a connector that could be downsized.

In order to achieve the aforementioned object, according to one aspect of the present invention, there is provided a connected for a coaxial cable including a body molded of insulating material and having an inner space; a receptacle adapted to removably receive a plug for the coaxial cable having a pole-shaped center contact. The receptacle includes a tubular body projecting outwardly from a surface of the body and having an inner space into which the center contact is inserted and which forms a housing space with the inner space of the body, a displaceable terminal made of conductive material and accommodated in the housing space, and a stationary terminal made of conductive material and accommodated in the housing space. The displaceable terminal has a contact piece urged from edge of the housing space toward the stationary terminal and being brought into abutment with the stationary terminal, and a base portion of the contact piece is closer to an aperture into which the center contact is inserted than the stationary terminal, and a middle portion placed between the base portion and an end portion of the contact piece projects into a passage for the center contact.

It is preferred that the displaceable terminal has a generally U-shaped retaining portion whose inner surface contacts an outer surface of the central contact inserted into the housing space. In this case, the base portion is preferably connected to the retaining portion.

It is also preferred that the contact piece has a first bending portion being closer to the base portion than a second bending portion and being bent so as to keep an end portion of the contact piece from the edge of the housing space, and the second bending portion being closer to the end portion than the first portion and being bent so as to move the end portion close to the edge of the housing space.

Advantageously, a beveling is formed at an inner surface of the body and the beveling forms a gap between the contact piece depressed by the center contact and the inner surface of the body when the plug is connected to the receptacle.

It is preferred that the connector may further include a ground terminal made of conductive material and placed on a surface of the tubular body; and a metal shell covering a surface of the body; wherein the ground terminal is electrically connected to the metal shell.

BRIEF DESCRIPTION OF THE DRAWINGS

This and other objects and features of the present invention will become clear from the following description taken in conjunction with a preferred embodiment thereof with reference to the accompanying drawings throughout which like parts are designated by like reference numerals, and in which.

DETAILED DESCRIPTION OF THE PREFERRED EMBODIMENTS

Figure 1A:
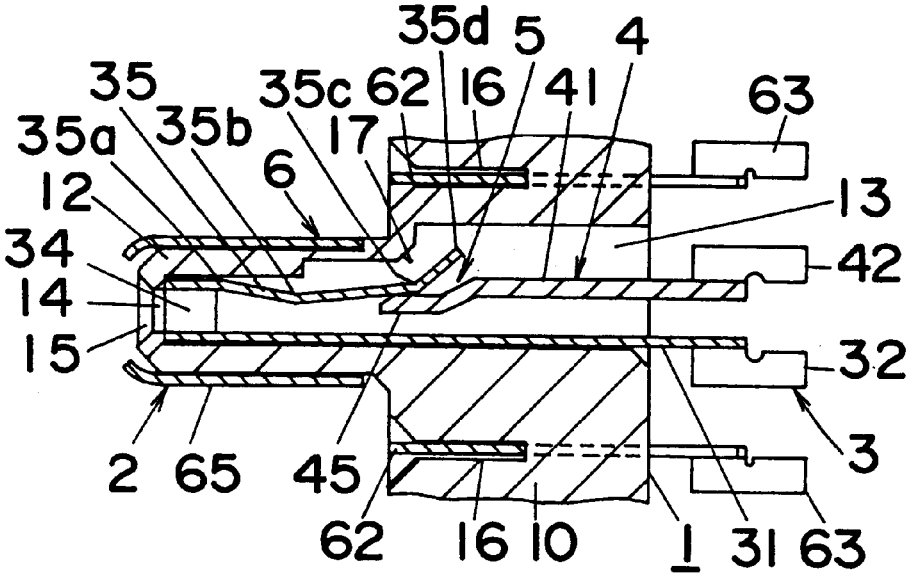
FIG. 1A shows a sectional view of a connector for a coaxial cable of a present invention without a plug.
Figure 1B:
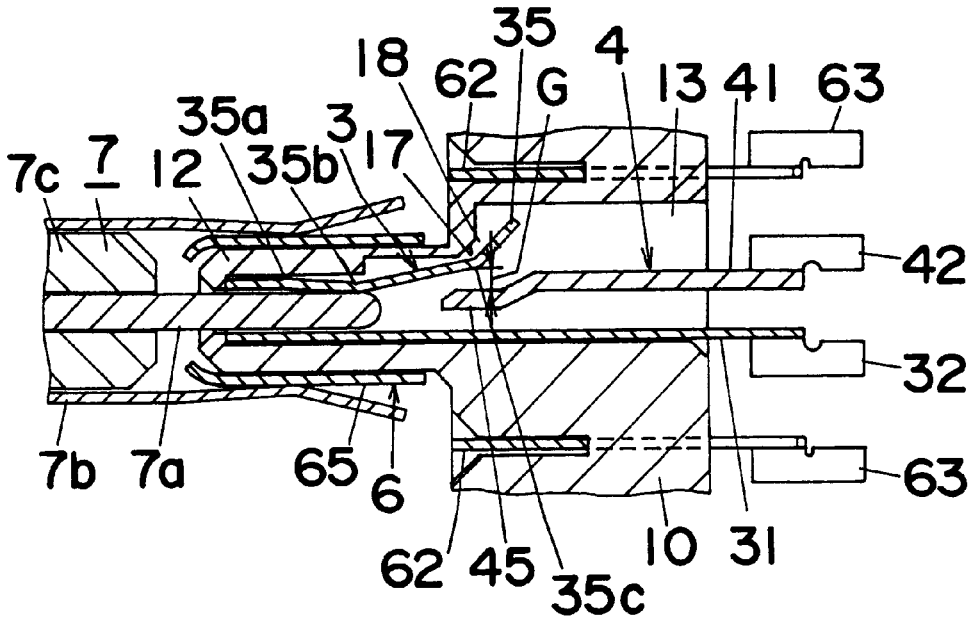
FIG. 1B shows a sectional view of the connector for the coaxial cable of the present invention with the plug.

Referring to FIGS. 1A and 1B, a connector 1 for a coaxial cable has a generally rectangular parallelepiped body 10, which is molded of an insulating material such as a synthetic resin. The body 10 has a tubular body 12 formed therewith so as to extend outwardly from the body 10 in a direction longitudinally thereof. An inner space of the tubular body 12 is fluid-connected with an inner space of the body 10 to define a housing space 13 in the connector 1.

A switch 5, which is a normally closed switch in the illustrated embodiment, is accommodated in the housing space 13. The switch 5 includes a displaceable terminal 3 and a stational terminal 4, both of which are made of an electroconductive material. The displaceable terminal 3 and the stationary terminal 4 are arranged so as to face towards each other. A tubular portion 65 of a ground terminal 6 is attached to, i.e., capped on an outer peripheral surface of the tubular body 12. The tubular body 12, the switch 5 and the ground terminal 6 altogether constitute a receptacle 2. The receptacle 2 is adapted to removably receive a plug 7 connected with a coaxial cable. The tubular body 12 has an aperture 14 defined at a free end thereof remote from the body 10, to permit the housing space 13 to be communicated with the outside of the connector. A lip region of a free end of the tubular body 12 around the aperture 14 is so chamfered as to permit the aperture 14 to represent a conical shape flaring outwardly in a direction coaxial with the tubular body 12 so that a center contact 7*a* of the plug 7 can be easily and smoothly inserted into the aperture 14. Also, the body 10 has grooves 16 defined therein for accommodating respective side pieces 62 of the ground terminal 6.

The plug 7 includes, in addition to the center contact 7*a*, a cylindrical base 7*c*, made of a moldable, electrically insulating material such as, for example, a synthetic resin by the use of any known molding technique, and an outer contact 7*b* positioned therearound. The center contact 7*a* extends coaxially through the base 7*c*. The outer contact 7*b* is of a generally tubular shape and is disposed exteriorly around the base 7*c*. An end portion of the outer contact 7*b* remote from the base 7*c* is flared outwardly to facilitate receipt of the tubular body 12 thereinto with the outer contact 7*b* held in contact with the ground terminal 6.

Figure 4:
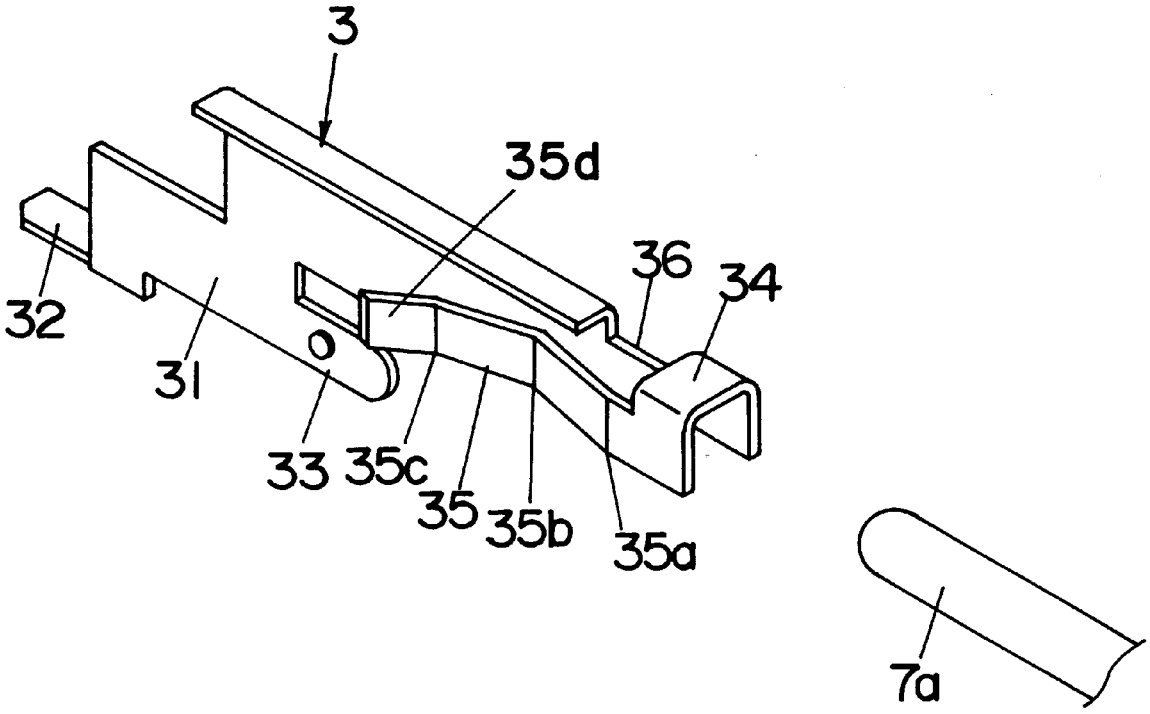
FIG. 4 shows a perspective view of a displaceable terminal of the connector of the present invention.

As shown in FIG. 4, the displaceable terminal 3 includes a central piece 31 and a soldering piece 32 integral with one end of the central piece 31 and lying at right angles to the central piece 32. The opposite end of the central piece 31 is branched off to define a fixing piece 33 and a bridge portion 34 extending substantially parallel to the fixing piece 33. The fixing piece 33 is utilized to fix the displaceable terminal 3 in position inside the body 10 by means of, for example, press-fitting. The bridge portion 34 is generally U-shaped and has an inner surface thereof adapted to be held in contact with an outer surface of the central contact 7*a* to thereby retain the central contact 7*a*. It is to be noted that although the displaceable terminal 3 has been described as fixed inside the body 10 with the fixing piece 3 press-fitted into the body 10, the displaceable terminal 3 may equally be fixed in the body 10 by the use of a bonding agent.

The displaceable terminal 3 is provided with a contact piece 35 at an end of the bridge portion 34. The contact piece 35 extends toward the soldering piece 32 in a direction conforming to the direction of insertion of the center contact 7*a*. The contact piece 35 is brought into abutment with the stationary terminal 4.

A base portion 35*a* of the contact piece 35 is bent toward the central piece 31. The contact piece 35 is provided with a first bending portion 35*b* and a second bending portion 35*c* between the base portion 35*a* and an end portion 35*d* of the contact piece 35. The first bending portion 35*b*, which is closer to the base portion 35*a* than to the second bending portion 35*c*, is used to contact the center contact 7*a*. The second bending portion 35*c*, which is closer to the end portion 35*d* than to the first bending portion 35*b*, contacts the stationary terminal 4. Incidentally, the central piece 31 is provided with a cutout 36 at one end thereof oppose to the soldering piece 32. Therefore, the bridge portion 34 is easy to bend when the central contact 7*a* is inserted, allowing the bridge portion 34 to be sufficiently deflected so as to contact and retain the central contact 7*a* positively.

Figure 5:
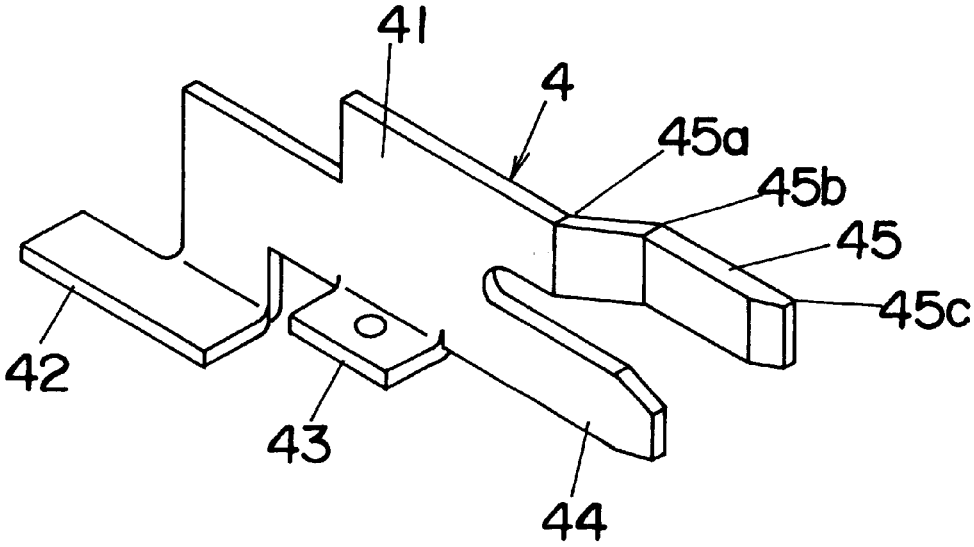
FIG. 5 shows a perspective view of a stationary terminal of the connector of the present invention.

As shown in FIG. 5, the stationary terminal 4 includes a central piece 41. The central piece 41 includes a soldering piece 42 that extends outwardly from one end thereof and lies at right angles to the central piece 41. The central piece 41 also includes a fixing piece 43 for fixing the stationary terminal 4 to the body 10, which piece 43 extends laterally outwardly from the central piece 41 and is positioned in a plane parallel to the plane in which the soldering piece 42 lies. The opposite longitudinal end of the central piece 41 remote from the soldering piece 42 is branched off to define a fixing piece 44 for fixing the stationary terminal 4 in the body 10 and a contact piece 44 engageable with the contact piece 35. The contact piece 45 is bent toward the opposite side of the soldering piece 42 and the fixing piece 43 at a base portion 45*a* thereof. The contact piece 45 is also bent at a middle portion 45*b* thereof to allow an end portion 45*c* of the contact piece 45 to extend parallel to the central piece 41. As shown in FIG. 1A, the contact piece 45 is positioned between the central piece 31 and the contact piece 35 with the end portion 45*c* normally held in contact with the second bending portion 35*c*.

Figure 6:
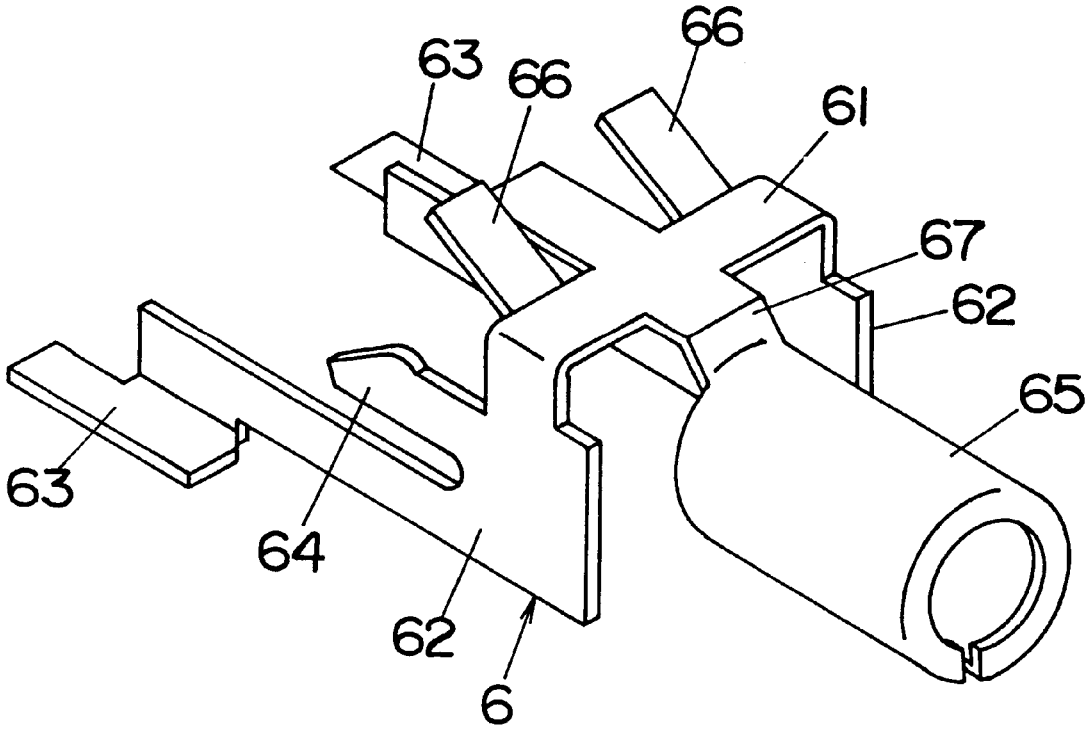
FIG. 6 shows a perspective view of a ground terminal of the connector of the present invention.
Figure 7A:
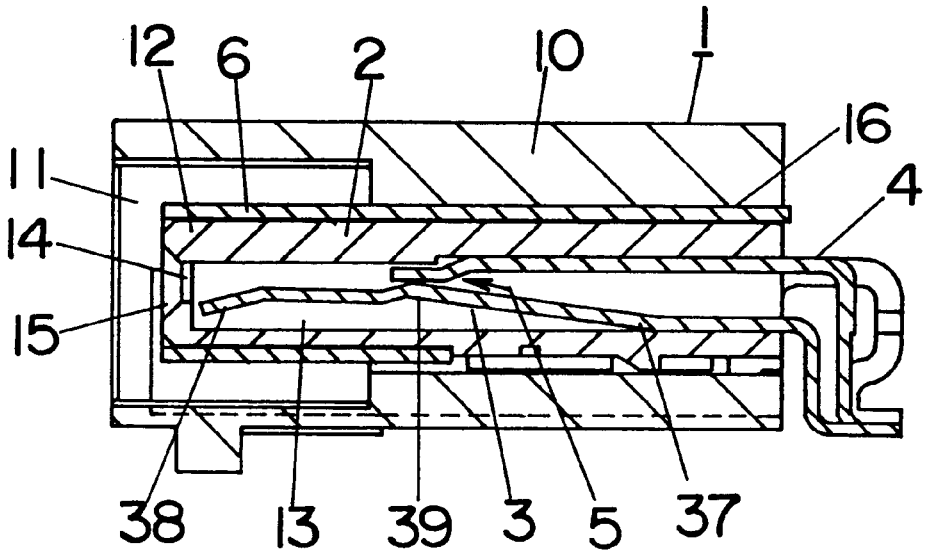
Fig.7A PRIOR ART
FIG. 7A shows a sectional view of the prior art connector without the plug.
Figure 7B:
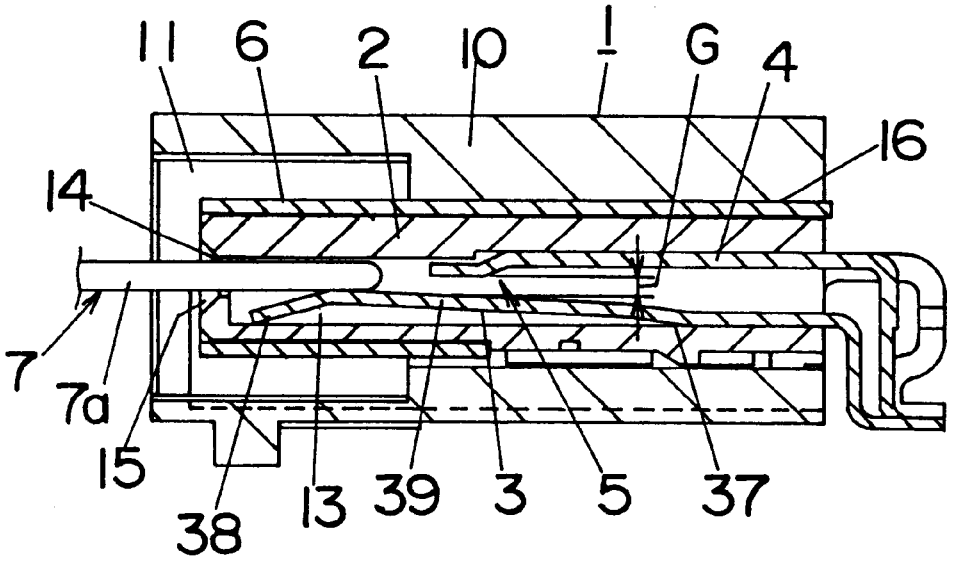
Fig.7B PRIOR ART
FIG. 7B shows a sectional view of the prior art connector with the plug.

As shown in FIG. 6, the ground terminal 6 includes a central piece 61 and two side pieces 62. Each side piece 62 extends outwardly from a corresponding end of the central piece 61 so as to intersect at right angles with the central piece 61. Each side piece 62 has a soldering piece 63 and a fixing piece 64 for fixing the ground terminal 6 to the body 10. The ground terminal 6 is provided with a tubular portion 65 at an opposite side of the soldering piece 63 through a connecting piece 67. The ground terminal 6 is also provided with contact pieces 66 at an edge of the central piece 62 opposite to the tubular portion 65. Each contact piece 66 has an elasticity for contacting the ground terminal 6 with a metal shell 9 covering a surface of the body 10. Each contact piece 66 is bent toward an opposite side of the side pieces 62. Therefore, when the body 10 is covered by the metal shell 9, the contact pieces 66 are depressed by the metal shell 9, and bent from the normal position shown by the phantom line in FIG. 2B. Then, the ground terminal 6 is electrically connected to the metal shell 9 through the contact pieces 66. As a result, an area of a ground can be broad and, also, a high-frequency characteristics can be improved. Incidentally, the stational terminal 4 and the ground terminal 6 are fixed in position inside the body 10 through the fixing piece 43 and 44 and the fixing piece 64 by means of press-fitting or bonding or any other method.

Figure 2A:
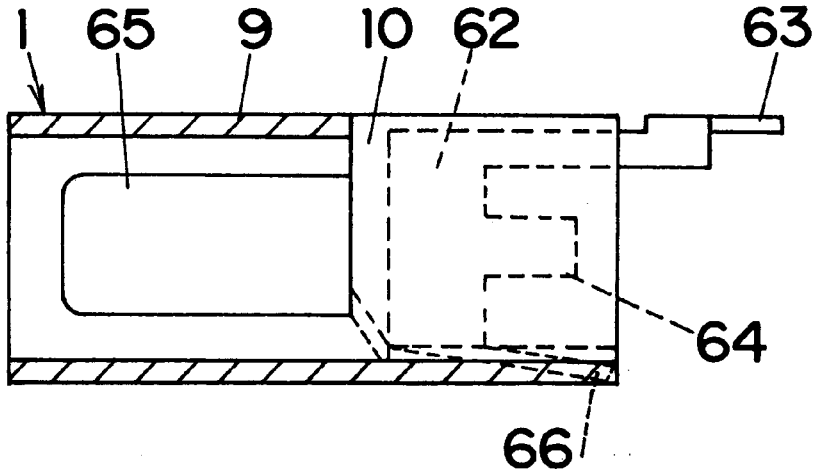
FIG. 2A is a sectional view of the connector of the present invention with parts partially broken away.
Figure 2B:
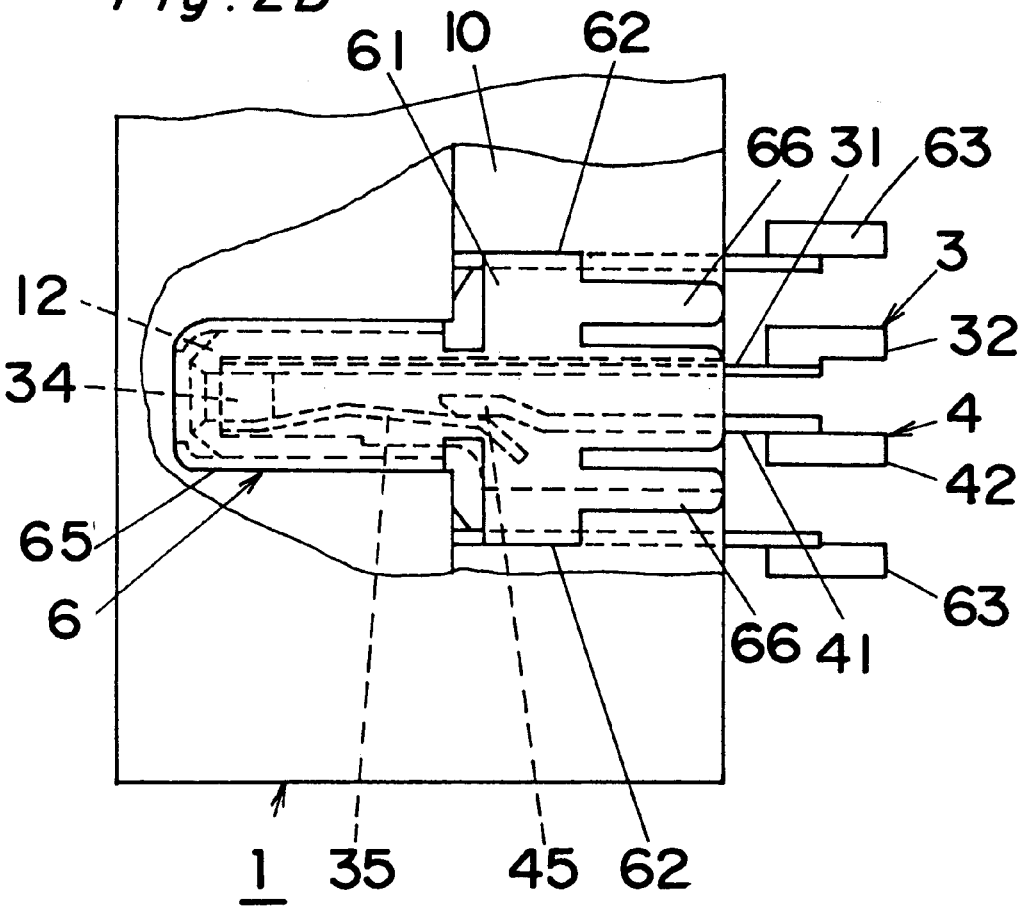
FIG. 2B is a sectional view of the connector of the present invention.

As shown in FIGS. 1A, 2A and 2B, the switch 5 is accommodated within the housing space 13. The switch 5 is defined by the displaceable terminal 3 and the stationary terminal 4. The contact piece 35 is urged toward the contact piece 45 and normally the contact piece 35 contacts the contact piece 45. Therefore, the switch 5 is a normally closed switch. As shown in FIG. 1B, when the plug 7 is connected to the receptacle 2, the center contact 7*a* is inserted into the housing space 13 via the aperture 14. Then, the center contact 7*a* is retained by the bridge portion 34 and electrically connected to the stationary terminal 4. The center contact 7*a* depresses the first portion 35*b* outwardly, thereby depressing contact piece 35 so as to separate the contact piece 35 from the contact piece 45. As a result, the contact between the contact piece 35 and the contact piece 45 is released, in which condition the switch 5 is turned off. In this condition, the outer contact 7*b* contacts with the tubular portion 65 and the outer contact 7*b* is electrically connected to the ground terminal 6.

As described above, the center contact 7*a* depresses the first portion 35*b* outwardly when the plug 7 is connected to the receptacle 2, the distance of travel of the second bending portion 35*c* is larger than that exhibited in the prior art coaxial cable connector. Therefore, the gap G between the displaceable terminal 3 and the stationary terminal is increased, and an isolation characteristics of the switch 5 is better than that exhibited by the prior art connector. Further, according to the connector described above, the switch 5 can be selectively opened and closed with no fault. Because of the gap G being sufficiently large, it is unnecessary to increase the size of the body 10 to gain the sufficient gap. That is, the connector of the present invention could be downsized.

Also, as the displaceable terminal 3 is provided with the contact piece 35 at an end of the bridge portion 34 and the contact piece 35 extends toward the soldering piece 32 in a direction conforming to the direction of insertion of the center contact 7*a,* the contact piece 35 does not buckle in contact with the center contact 7*a* being inserted.

The displaceable terminal 3 contacts the center contact 7*a* through the bridge portion 34 and the first bending portion 35*b,* and contacts the stationary terminal 4 through the second bending portion 35*c*. That is, as the contact piece 35 contacts the stationary terminal 4 through the portion that is not depressed by the center contact 7*a,* the center contact 7*a* and the stationary terminal 4 are separated from each other. Therefore, if the degree of deflection of the contact portion 35 is increased, the housing space 13 could be made small and the receptacle 2 could be downsized. Incidentally, a beveling 17 is formed at an inner surface of the body 10 so as to secure a gap between the contact piece 35 depressed by the center contact 7*a* and the inner surface of the body 10 when the plug 7 is connected to the receptacle 2, thereby avoiding a contact of the contact piece 35 with the inner surface of the body 10.

In fabrication, the displaceable terminal 3 is inserted into the housing space 13 through an aperture opposite to the aperture 14 of the body 10, followed by insertion of the stationary terminal 4 into the housing space 13 through the same aperture. As a result, the head of the stationary terminal 4 brushes the second bending portion 35*c,* thereby removing the fouling that is stuck on the surface of the second bending portion 35*c*.

Figure 3A:
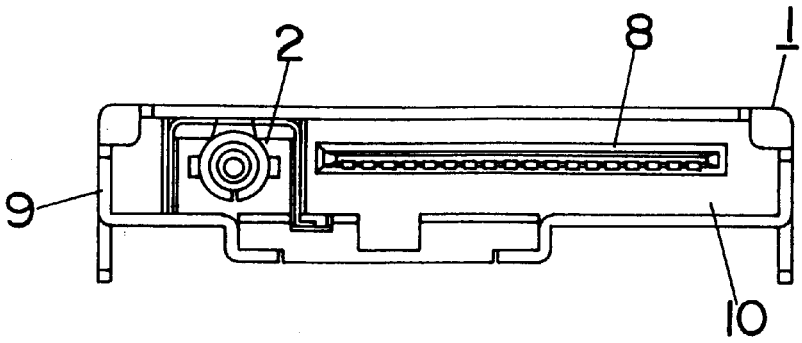
FIG. 3A is a front view of the connector of the present invention.
Figure 3B:
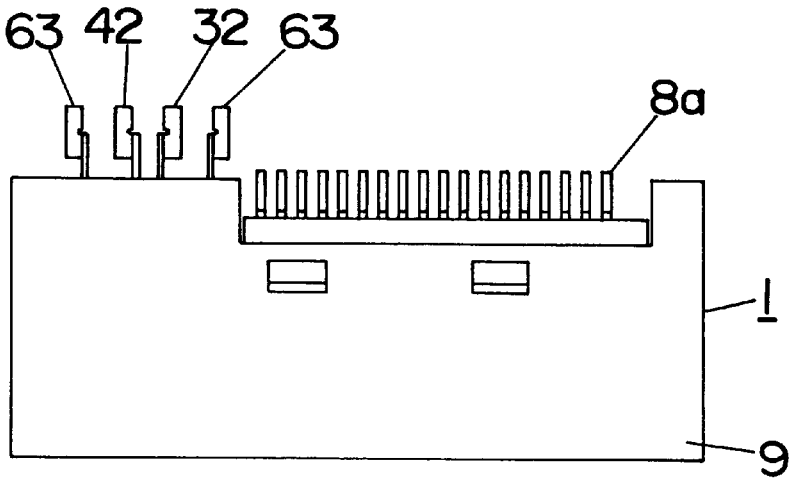
FIG. 3B is a plain view of the connector of the present invention.
Figure 3C:
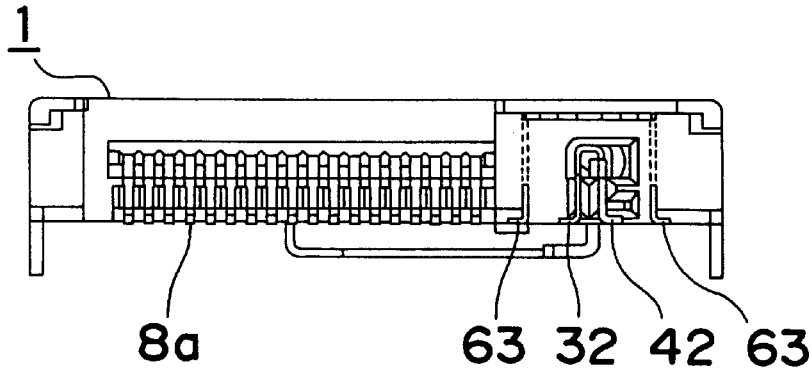
FIG. 3C is a rear view of the connector of the present invention.

As shown in FIGS. 3A and 3B, in the present invention, a different socket 8 for receiving a different plug (not shown), such as a card edge connector, is disposed in parallel relation to the tubular body 12. On the other hand, the soldering pieces 32, 42 and 63 and pin terminals 8*a* of the socket 8 are disposed in parallel relation to each other at the side surface of the body 10 opposite to the tubular body 12. Surfaces of the body 10 except for surfaces at which the tubular body 12 and the soldering pieces 32, 42 and 63 are disposed are covered with the metal shell 9, and an edge of the metal shell 9 projects to the head of the receptacle 2. Incidentally, in this embodiment, the socket 8 is disposed in parallel relation to the tubular body 12, but other connectors can be disposed.

Although the present invention has been fully described in connection with the preferred embodiment thereof and the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector for a coaxial cable comprising:

a body molded of an insulating material and having an inner cavity;

a receptacle having a plurality of conductor terminals adapted to removably receive a plurality of associated terminals on a printed circuit board and a socket for removably receiving the coaxial cable having a pole-shaped center contact, said receptacle comprising:

a tubular body projecting outwardly from a surface of said body and having an inner space into which the pole-shaped center contact is inserted wherein said tubular body inner space continuously connects to said molded body inner space:

a common terminal made of a conductive material and accommodated in the housing space; and a receiving terminal made of a conductive material and accommodated in the housing space;

wherein said common terminal has a contact piece urged from an edge of said housing space toward said receiving terminal and being brought into abutment with said receiving terminal, and a base portion of said contact piece is closer to an aperture into which the pole-shaped center contact is inserted than said receiving terminal, and a middle portion placed between said base portion and an end portion of the pole-shaped contact piece that projects into a passage for said center contact.

2. The connector for a coaxial cable as defined in claim 1, wherein said common terminal has a generally U-shaped contacting portion whose inner surface contacts with an outer surface of said central contact inserted into said housing space, and said base portion is connected to said retaining portion.

3. The connector for a coaxial cable as defined in claim 1, wherein said contact piece comprises a first bending portion and a second bending portion, said first bending portion being positioned closer to said base portion than said second bending portion and being bent so as to keep an end portion of said contact piece from said edge of said housing space, and said second bending portion being positioned closer to said end portion than said first bending portion and being bent so as to move said end portion close to said edge of said housing space.

4. The connector for a coaxial cable as defined in claim 1, wherein a beveling is formed at an inner surface of said body and said beveling forms a gap between said contact piece that is depressed by said center contact and said inner surface of said body when said plug is connected to said receptacle.

5. The connector for a coaxial cable as defined in claim 1, further comprising:

a ground terminal made of a conductive material and placed on a surface of said tubular body; and a metal shell covering a surface of said body;

wherein said ground terminal is electrically connected to said metal shell.

6. The connector for a coaxial cable as defined in claim 1, further comprising a ground terminal made of conductive material securely attached to said body, said ground terminal having a tubular sleeve portion which slides over said tubular portion of said body at one end and a pair of soldering terminals at an other end;

wherein said contact piece is configured to form an electrical switch; and wherein said connector is adapted to connect a male connector of a coaxial cable to an outer side of the tubular sleeve portion by the pole-shaped center contact so that a male center contact of said male connector is inserted into said aperture of said tubular portion so as to form an electrically conductive contact with said common terminal and causes said switch to assume an open orientation.

* * * * *